US006913441B2

(12) United States Patent
Fadok

(10) Patent No.: US 6,913,441 B2
(45) Date of Patent: Jul. 5, 2005

(54) TURBINE BLADE RING ASSEMBLY AND CLOCKING METHOD

(75) Inventor: Joseph J. Fadok, Winter Springs, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 0 days.

(21) Appl. No.: 10/654,746

(22) Filed: Sep. 4, 2003

(65) Prior Publication Data

US 2005/0053457 A1 Mar. 10, 2005

(51) Int. Cl.[7] ..... F01D 9/04
(52) U.S. Cl. ..... 415/189; 415/191; 415/209.2
(58) Field of Search ..... 415/151, 189, 415/191, 209.2

(56) References Cited

U.S. PATENT DOCUMENTS

| | | | | |
|---|---|---|---|---|
| 2,556,890 | A * | 6/1951 | Thorn | 415/136 |
| 2,971,333 | A | 2/1961 | Mendelsohn et al. | |
| 4,292,008 | A * | 9/1981 | Grosjean et al. | 415/115 |
| 4,925,363 | A | 5/1990 | Brown et al. | |
| 5,141,394 | A | 8/1992 | Donlan | |
| 5,224,825 | A | 7/1993 | Strang et al. | |
| 5,380,154 | A | 1/1995 | Norton et al. | |
| 5,486,091 | A | 1/1996 | Sharma | |
| 5,618,161 | A | 4/1997 | Papageorgiou et al. | |
| 5,681,142 | A | 10/1997 | Lewis | |
| 5,779,442 | A | 7/1998 | Sexton et al. | |
| 5,921,749 | A | 7/1999 | McLaurin et al. | |
| 6,174,129 | B1 * | 1/2001 | Mazzola et al. | 415/127 |
| 6,224,332 | B1 | 5/2001 | Leach et al. | |
| 6,402,458 | B1 | 6/2002 | Turner | |
| 6,457,936 | B1 | 10/2002 | Leach et al. | |

FOREIGN PATENT DOCUMENTS

| | | |
|---|---|---|
| EP | 1 247 938 A2 | 10/2002 |
| JP | 2002155701 A2 | 5/2002 |
| WO | WO 95/29331 | 11/1995 |

* cited by examiner

*Primary Examiner*—Ninh H. Nguyen

(57) ABSTRACT

Aspects of the invention relate to a method for clocking a row of stationary airfoils relative to an adjacent row of airfoils, and a turbine blade ring configured for use in such a method. The method according to aspects of the invention is advantageous because it can avoid extensive disassembly of the turbine in order to clock the blade ring. The method includes engaging the outer peripheral surface of a blade ring with a plurality of roller pins such that the weight of the blade ring is entirely supported by the roller pins. A tangential force is applied to the blade ring such that the blade ring rotates on the roller pins, thereby adjusting the position of the stationary airfoils affixed to the blade ring. Additional rotational adjustments can be made to the blade ring until the blade ring is clocked to the desired position.

20 Claims, 4 Drawing Sheets

TURBINE BLADE RING ASSEMBLY AND CLOCKING METHOD

FIELD OF THE INVENTION

The invention relates in general to turbine engines and, more particularly, to a turbine blade ring or vane carrier configuration and a method for clocking a row of stationary airfoils.

BACKGROUND OF THE INVENTION

The turbine section of a turbine engine includes one or more rows of stationary airfoils, commonly referred to as vanes or stationary blades. In some applications, each row comprises a plurality of vanes that are affixed to the inner periphery of a blade ring or other vane carrier. The rows of vanes are interspaced between rows of rotating airfoils, commonly referred to as blades. The relative positioning of two rows of airfoils, known as the clocking, can affect the efficiency of the turbine.

One method for clocking a row of airfoils is to rotate the blade ring so as to change the position of the attached airfoils. However, current clocking methods require the disassembly and/or removal of at least a substantial portion of the outer turbine casing that encloses the blade ring and to which the blade ring is attached. Such removal and/or disassembly can be expensive, time consuming, and labor intensive.

Thus, one object according to aspects of the present invention is to provide a method for clocking a row of airfoils relative to at least a preceding and/or subsequent row of airfoils. Another object according to aspects of the present invention is to allow for blade ring clocking without extensive disassembly of all or a part of the turbine. Yet another object according to aspects of the present invention is to facilitate rapid blade ring clocking. A further object according to aspects of the present invention is to provide a blade ring having one or more features to assist in blade ring clocking. These and other objects according to aspects of the present invention are addressed below.

SUMMARY OF THE INVENTION

Aspects of the invention relate to a method for clocking a blade ring containing a plurality of airfoils relative to another row of airfoils. At the outset various components such as an outer casing, a blade ring, and a plurality of pins are provided. The outer casing has an elongated hollow body, an outer peripheral surface and an inner peripheral surface. Further, the outer casing has a first set of openings and a second set of openings. Each of the openings extends between the outer peripheral surface and the inner peripheral surface of the outer casing.

The blade ring has an inner peripheral surface and an outer peripheral surface. The blade ring also includes a plurality of airfoils attached to the inner peripheral surface and a plurality of notches formed in the outer peripheral surface. The blade ring is disposed inside of the outer casing. A plurality of pins are inserted through the first set of openings in the outer casing and engage at least some of the notches in the outer peripheral surface of the blade ring such that the blade ring is substantially fixedly held within the outer casing.

Further, a plurality of roller pins are provided. Each roller pin has a roller at one end. The plurality of roller pins are inserted through the second set of openings in the outer casing such that the roller of each of the roller pins engages the outer peripheral surface of the blade ring. The pins can then be disengaged from the notches in the outer peripheral surface of the blade ring. Thus, the blade ring is held in position and supported by the at least three roller pins.

The blade ring can include at least one pair of attachments. The pair of attachments can include one of eyelets, lugs, hooks, loops, ears, posts, and hitches. A method according to aspects of the invention can further involve attaching a first actuator to one attachment of a first pair of attachments, and attaching a second actuator to the other attachment of the first pair of attachments. The first and second actuators can be one of cables, chains, straps, ropes, gears, hydraulic cylinders, cranes, and winches.

The blade ring can be rotated in a first direction by using the first and second actuators to impart substantially tangential forces on the blade ring. The first direction can be one of clockwise or counterclockwise. In one embodiment, the blade ring can be further rotated in either the first direction or a second direction by using the first and second actuators to impart substantially tangential forces on the blade ring. Rotation in one of the first direction or a second direction can be repeated until the blade ring is rotated into the desired position. Next, the plurality of pins can be reinstalled through the first set of openings in the outer casing such that the pins engage at least some of the notches in the outer peripheral surface of the blade ring such that the blade ring is substantially fixedly held within the outer casing. The plurality of roller pins can then be removed.

In another embodiment, the method according to aspects of the invention can further involve attaching a third actuator to an attachment of a second pair of attachments, and attaching a fourth actuator to the other attachment of the second pair of attachments. The third and fourth actuators can be one of cables, chains, straps, ropes, gears, hydraulic cylinders, cranes, and winches. The blade ring can be rotated in a second direction by using the third and fourth actuators to impart substantially tangential forces on the blade ring. The steps of using the first and second actuators to rotate the blade ring and/or using the third and fourth actuators to rotate the blade ring can be repeated, as necessary, until the blade ring is rotated into the desired position.

Other aspects according to the invention relate to a blade ring for a turbine engine. The blade ring can comprise hollow substantially cylindrical body having an inner peripheral surface and an outer peripheral surface. A plurality of airfoils are attached to the inner peripheral surface of the body. Further, a plurality of notches are in the outer peripheral surface of the body. At least one pair of attachments are provided on the outer peripheral surface of the body.

The at least one pair of attachments can be one of eyelets, lugs, hooks, loops, ears, posts, and hitches. One of the attachments of the at least one pair of attachments can be disposed so as to be substantially peripherally opposite to the other attachment of the at least one pair of attachments. The plurality of notches can be disposed substantially equidistantly about the outer periphery of the blade ring. Further, the plurality of notches can include at least four groups of notches where each group includes three notches. The groups of notches can be disposed substantially equidistantly about the outer periphery of the blade ring.

Still other aspects of the invention relate to another method for clocking a blade ring containing a plurality of airfoils relative to another row of airfoils. The method includes providing an outer casing that has an elongated hollow body, an outer peripheral surface and an inner peripheral surface. The outer casing has a first set of openings and a second set of openings. Each of the openings extends between the outer peripheral surface and the inner peripheral surface of the outer casing.

Further, a blade ring is provided. The blade ring is disposed inside of the outer casing. The blade ring has an inner peripheral surface and an outer peripheral surface. The blade ring includes a plurality of airfoils attached to the inner peripheral surface and a plurality of notches formed in the outer peripheral surface. The blade ring includes at least one integral pair of attachments and the outer casing includes at least one removable access panel for permitting access to the at least one pair of attachments.

In addition, a plurality of pins are provided. The pins are inserted through the first set of openings in the outer casing and engage at least some of the notches in the outer peripheral surface of the blade ring. As a result, the blade ring is substantially fixedly held within the outer casing.

At least three roller pins are provided. Each of the roller pins has a roller at one end. The at least three roller pins are inserted through the second set of openings such that the roller of each of the roller pins engages the outer peripheral surface of the blade ring. The pins are then disengaged from the notches in the outer peripheral surface of the blade ring. Thus, the blade ring is substantially held in position and substantially supported by the at least three roller pins.

The at least one access panel is removed. A first actuator is attached to one attachment of a first pair of attachments; a second actuator is attached to the other attachment of the first pair of attachments. The first and second actuators can be one of cables or chains. The blade ring is then rotated by substantially simultaneously pulling the first and second actuators so as to impart substantially tangential forces on the blade ring. Rotation of the blade ring is facilitated by engagement of the outer peripheral surface of the blade ring with the roller pins.

DETAILED DESCRIPTION OF EMBODIMENTS OF THE INVENTION

Aspects of the present invention address the shortcoming associated with prior blade ring configurations and clocking methods. Aspects of the present invention relate to a method for clocking a turbine blade ring so as to position a row of vanes relative to at least a preceding and/or subsequent row of airfoils. Other aspects of the present invention are directed to a turbine blade ring configuration that can facilitate such methods.

Embodiments of the invention will be explained in the context of one possible turbine configuration, but the detailed description is intended only as exemplary. Embodiments of the invention are shown in FIGS. 1–4, but the present invention is not limited to the illustrated structure or application.

Figure 1:
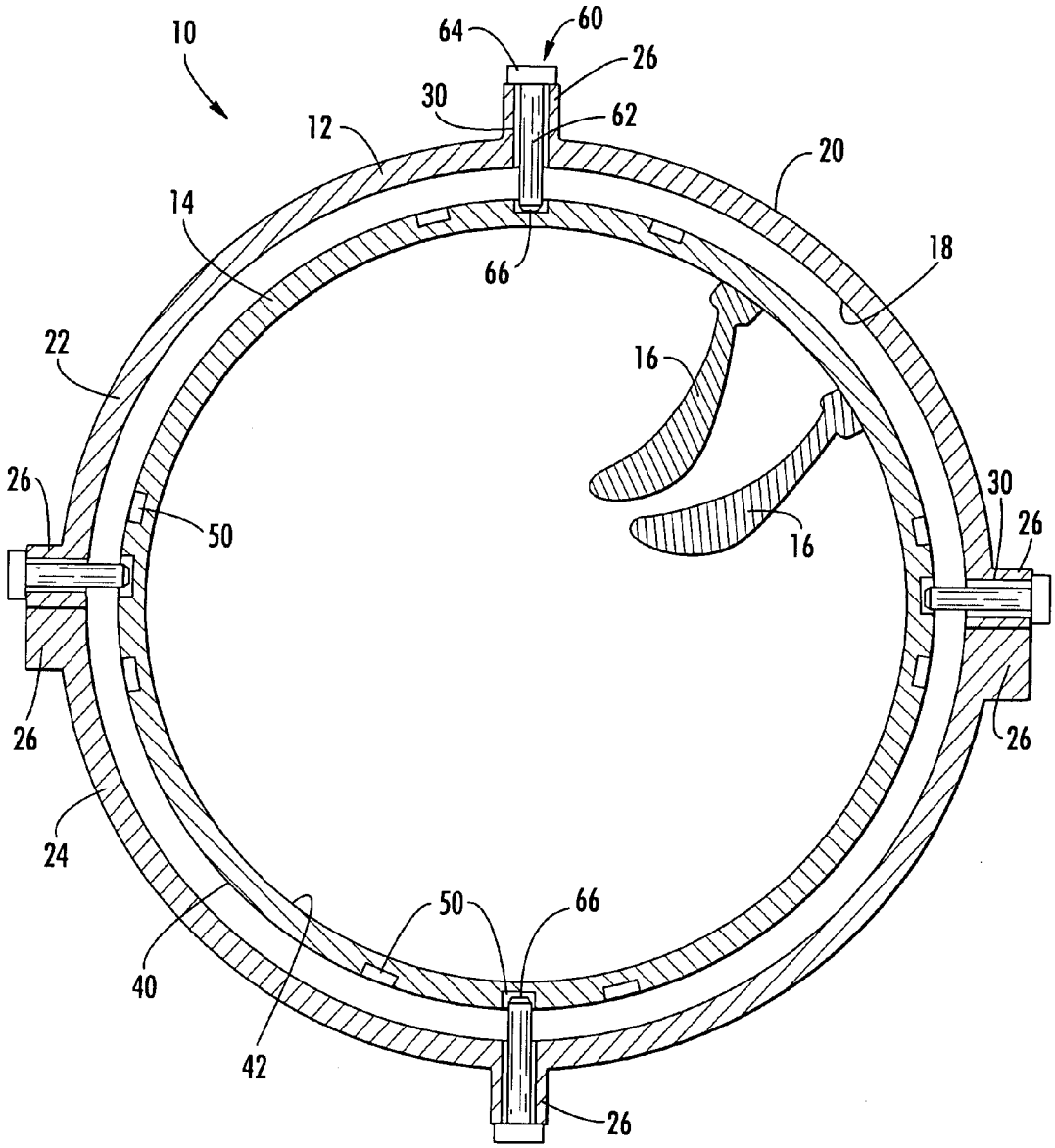
FIG. 1 is a cross-sectional view through the turbine section of a turbine engine, taken at a first axial location, showing the blade ring held in place by a plurality of anti-rotation pins.
Figure 2:
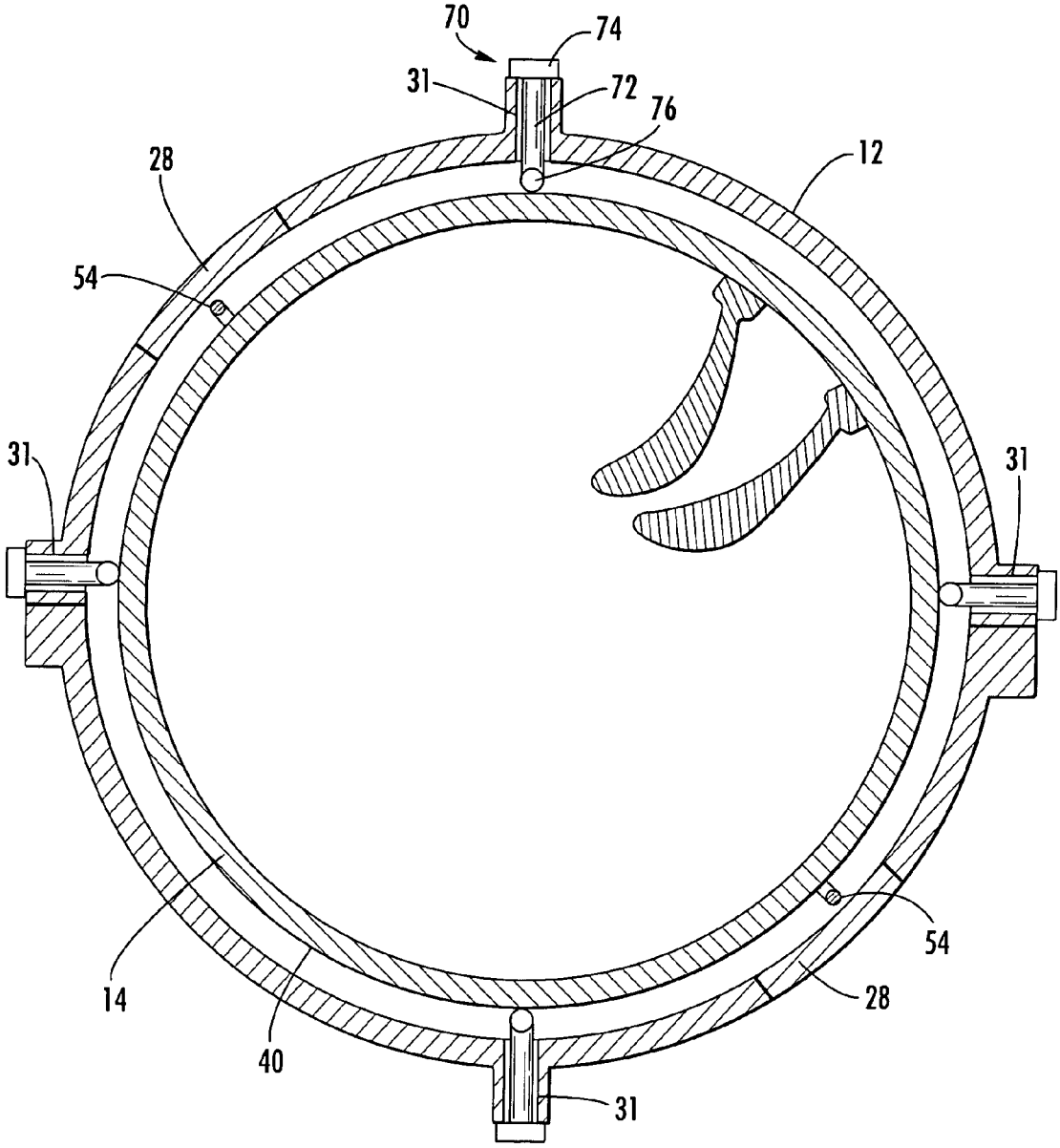
FIG. 2 is a cross-sectional view through the turbine section of a turbine engine, taken at a second axial location, showing a plurality of roller pins installed through the outer casing and engaging an outer peripheral surface of the blade ring.
Figure 3:
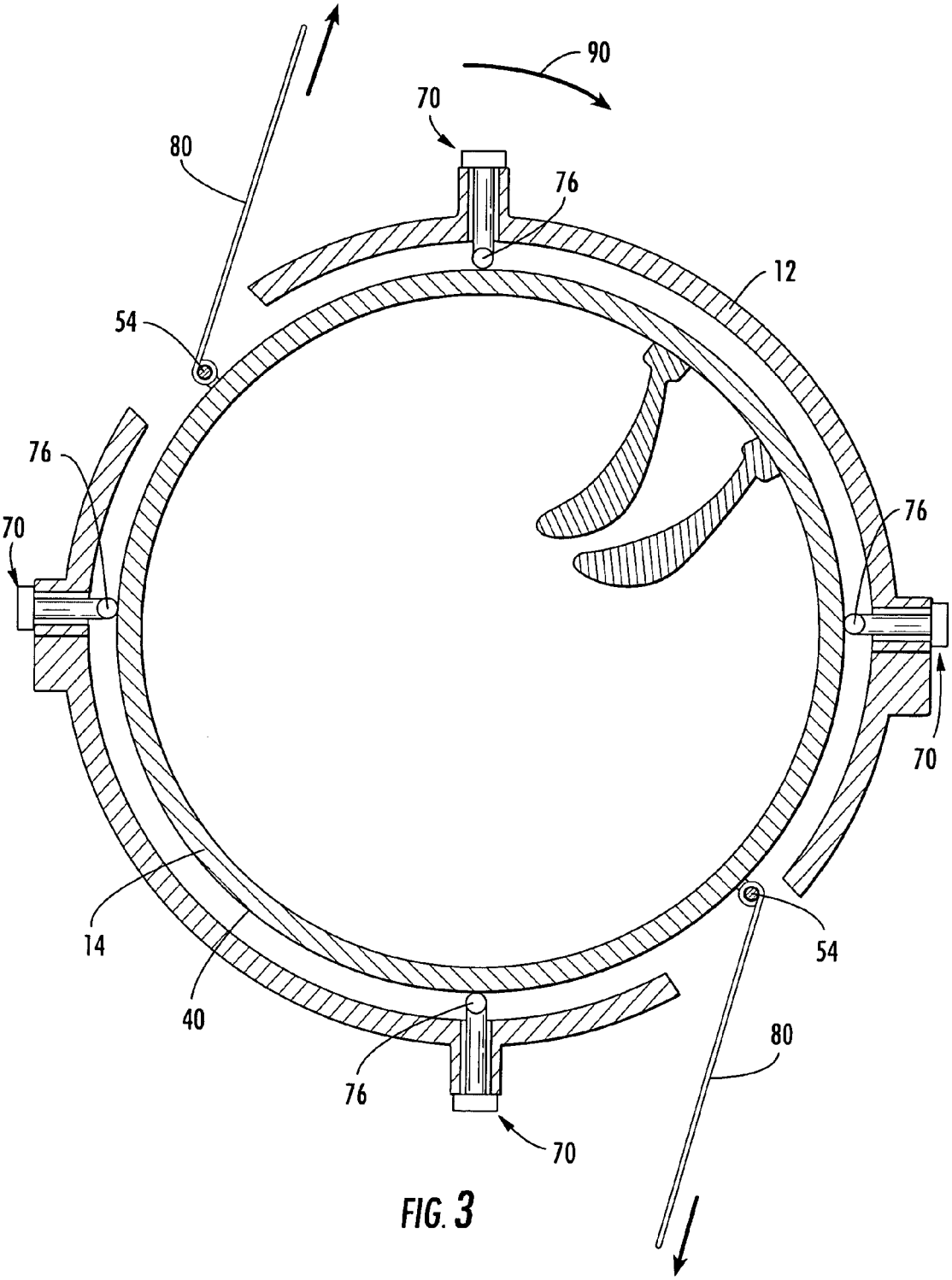
FIG. 3 is a cross-sectional view through the turbine section of a turbine engine, taken at the second axial location, showing the access covers removed and the actuators attached to the pair of attachments on the blade ring.

An example of a turbine assembly 10, configured according to aspects of the invention, is shown in FIG. 1. The turbine assembly 10 can include a variety of components such as an outer casing 12, a blade ring 14 held in substantially fixed relation to the outer casing by several anti-rotation pins 60, and a plurality of vanes 16 (only two vanes are shown for the sake of clarity) affixed to the blade ring 14. These and other components according to aspects of the present invention will be described in turn below.

The outer casing 12 is a component that is well known in the art. The outer casing 12 can comprise a hollow elongated body. The outer casing 12 can be any of a number of shapes such as generally polygonal, generally rectangular, or, preferably, generally cylindrical. Further, the outer casing 12 can have an inner peripheral surface 18 and an outer peripheral surface 20.

The outer casing 12 can substantially enclose most, if not all, of the components of the turbine section of the engine. The outer casing 12 can be a single part construction or it can be a multi-part assembly as shown in FIG. 1. For example, the outer casing 12 can be an assembly of two halves such as an upper half 22 and a lower half 24. Alternatively, the outer casing 12 can comprise a right half and a left half. Further, the outer casing 12 can be made from any number of longitudinal panels such as, for example, four panels, or any number of axial segments. The outer casing 12 can have localized areas of increased thickness 26 at the junction between two halves or in other locations. In one embodiment, the areas of increased thickness 26 can be provided generally in the 12, 3, 6, and 9 o'clock positions.

An outer casing 12 according to aspects of the invention can be provided with access panels 28 (FIG. 2) to permit a user to access turbine components enclosed within the casing 12 such as the blade ring 14 and attachments 54. There may be any number of access panels 28. For example, in one embodiment, there are at least two access panels 28. In another embodiment, there can be four access panels 28. The access panels 28 can be removably secured to the outer casing 12 such as by one or more fasteners including bolts, clasps, latches, hinges, and retainers to name a few.

Further, the outer casing 12 can include one or more openings 30 extending through the thickness of the outer casing 12, that is, between the inner and outer peripheral surfaces 18,20 of the outer casing 12. The openings 30 can extend through the thickness of the outer casing 12 at any orientation relative to the outer surface 20. In one embodiment, the openings 30 can extend substantially toward the centerline of the outer casing 12. Preferably, the openings 30 are located in the areas of increased thickness 26 as shown in FIG. 1.

The geometry of the openings 30 depends on the parts that will be received within the openings as discussed below. In one embodiment, the openings 30 are substantially circular in cross-section. However, the openings 30 can have any of a number of cross-sectional geometries such as polygonal, rectangular, semi-circular, or triangular, to name a few. Further, the cross-sectional area of the openings 30 can be substantially constant through the thickness of the outer casing 12 or the cross-sectional area can vary, such as by including a taper. While the openings 30 are preferably substantially identical to each other, the openings 30 are not necessarily substantially identical in their cross-sectional conformation or in other respects.

In one embodiment, there can be two or more sets or groups of openings. For example, a first group can comprise openings 30, which can be dedicated to receiving the anti-rotation pins 60; a second group can comprise openings 31, which can be dedicated to receiving roller pins 70 as will be discussed below. The groups of openings, such as the first and second group, can be located at different axial locations along the length of the outer casing 12.

Within each group, the openings may or may not be located at the same axial distance from one end of the outer casing 12. For example, in the first group, at least one of the openings 30 can be located at a first axial distance from one end of the outer casing 12, and at least one of the remaining openings 30 of the first group can be located at a second axial distance from the end of the outer casing 12. The first axial distance and the second axial distance are unequal.

Further, the openings 30,31 in each group may or may not be aligned from left-to-right or from top-to-bottom. For example, in the case of four openings, the openings can be provided near the top and bottom of the outer casing such that the openings are substantially aligned. Alternatively, the openings 30,31 can be offset from each other. Similar relationships may or may not occur between the openings 30,31 disposed on the right and left sides of the outer casing 12. In addition, with respect to the right and left openings, it is preferred if the openings are provided as close to a substantially horizontal plane including the centerline of the blade ring 14 as possible. It should be noted that the relative terms such as top, bottom, right and left are used to facilitate discussion in connection with FIGS. 1–4; however, these terms are not intended to limit the scope of the invention.

There can be any number of openings. For example, in one case, at least three openings 30 are provided within each group of openings. In another case, there are four openings 30 within each group. Regardless, of the number of openings, the openings can be spaced substantially equidistantly about the outer periphery of the outer casing 12. However, there need not be any particular spatial relationship between the openings 30. Further, in the case of multiple groups of openings, the groups can have the same general arrangement or they can be substantially different.

Figure 4:
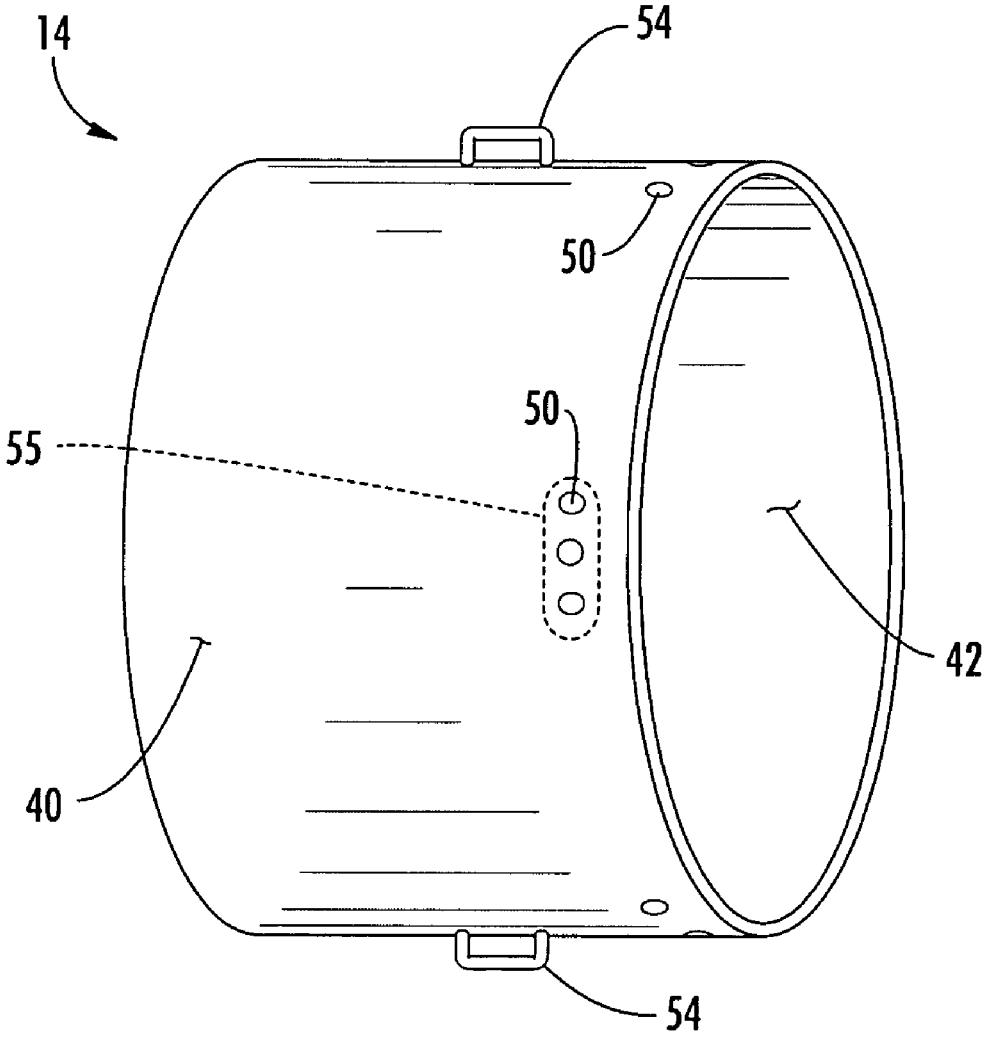
FIG. 4 is an isometric view of a vane carrier configuration according to aspects of the invention.

Aspects of the invention can further relate to a configuration for a blade ring or other vane carrier 14. An example of a blade ring 14 according to aspects of the invention is shown in FIG. 4. The blade ring 14 can comprise a substantially hollow body having an outer peripheral surface 40 and an inner peripheral surface 42. The body can be substantially cylindrical, conical or combinations thereof. A plurality of vanes 16 can be affixed to the inner peripheral surface 42 of the blade ring 14. Further, the blade ring 14 can be a single or multi-part construction.

The blade ring 14 can include one or more notches 50 in its outer peripheral surface 40 for receiving at least a portion of the anti-rotation pins 60. The notches 50 can be provided at almost any depth in the thickness of the blade ring 14. Further, the notches 50 can be disposed at almost any orientation with respect to the outer peripheral surface 40 of the blade ring 14, but it is preferred if the notches 50 extend substantially toward the centerline of the blade ring 14.

The notches 50 can be any shape so long as they can matingly receive a pin 60 so as to at least prevent the blade ring from rotating relative to the outer casing 12. The above discussion regarding the position, orientation and geometry of the openings 30 applies to the position, orientation and geometry of the notches 50 as well. Blade rings are well known in the art, and the above described features are provided in the way of an example. Aspects of the invention are not limited to any particular blade ring conformation.

For every opening 30 in the outer casing 12, there can be a dedicated notch 50 for receiving an anti-rotation pin 60. In such case, the range of motion for the clocking is limited. Thus, instead of providing dedicated openings for a specific pin 60, aspects of the invention relate to providing a plurality of notches 50 so that the blade ring 14 can be held in various positions relative to the outer casing 12. For example, notches 50 can be provided substantially about the entire outer periphery 40 of the blade ring 14. Alternatively, there may be localized groups of notches 55 having two or more notches 50 disposed substantially side-by-side. For example, there can be four groups of notches 55, each group containing at least three notches, disposed about the outer periphery 40 of the blade ring 14. Preferably, the notches 50 or groups of notches 55 are spaced substantially equidistantly about the outer periphery 40 of the blade ring 14.

The blade ring 14 according to aspects of the invention can have one or more features to facilitate blade ring clocking. For example, the blade ring 14 can provide one or more pairs of attachments 54 to which an actuator can be attached. The attachments in each pair can be substantially identical or they can be different. Preferably, for each pair of attachments, the two attachments 54 are disposed substantially peripherally opposed to each other about the outer periphery 40 of the blade ring 14.

Examples of attachments 54 include lugs, hooks, eyelets, loops, ears, posts and hitches, to name a few. The attachments 54 can be secured to the blade ring 14 by welding, brazing, fasteners, or threaded engagement so as to be integral with the blade ring 14. In addition, the attachments 54 can be cast into the blade ring 14 itself. Further, the attachments 54 can be secured to the blade ring 14 as needed during clocking operations.

Aspects of the invention relate to one or more pins 60 such as torque pins for preventing the rotation of the blade ring 14 within the outer casing and/or for providing vertical support of the blade ring 14. The pins 60 further maintain a sufficient clearance between the blade ring 14 and the outer casing 12. The pins 60 generally comprise an elongated shaft 62 and can further include a head portion 64.

The elongated shaft 62 can have any of a number of cross-sectional areas including, for example, circular, polygonal, rectangular, and triangular. Preferably, the shaft 62 is substantially cylindrical having a substantially constant cross-sectional geometry. Alternatively, the shaft 62 can be tapered. The pins 60 can provide a head portion 64 so as to allow a user to retrieve the pin 60 while reducing the height at which the pin 60 extends from the outer casing 12. The head 64 can be any shape such as circular or hexagonal.

The shaft 62 of the pin 60 culminates at a tip 66 that engages the one or more notches 50 in the outer surface 40 of the blade ring 14. The tip 66 can include one or more features such as a chamfer or one or more flats to facilitate engagement with the notches 50. The pins 60 can be made in any of a number of ways such as by machining or casting, to name a few. The pins 60 can be made from any of a variety of materials such as alloy steel.

Aspects of the invention relate to one or more roller pins 70. Like the pins 60 discussed above, the roller pins 70 include a shaft 72 and can further include a head portion 74 at one end. In one case, the shaft and head portions 72,74 of the roller pins 70 can be substantially identical to the shaft and head portions 62,64 of the anti-rotation pins 60. In addition, the roller pins 70 can be configured to have a roller 76 at the end opposite the head end 74 so as to facilitate movement of the blade ring 14.

The roller 76 can be any of a number of designs as one skilled in the art would appreciate. For example, the roller 76 can be one or more wheels rotatably attached to an axle. In addition, the roller can be a captive rotatable ball. Additional examples of roller pins 70 can be found in U.S. Pat. Nos. 5,779,442 and 6,224,332, which are incorporated by reference. Preferably, the roller portion 76 of the roller pin 70 is substantially the same width or diameter as the shaft portion 62 of the pin 60. The size, design and quantity of roller pins 70 can depend on the amount of load that each roller pin 70 must carry during the clocking process. Any number of roller pins 70 can be used and, in one embodiment, there are at least three roller pins 70.

Aspects of the invention further relate to actuators that can be attached to the at least one pair of attachments 54 on the blade ring 14. Depending on the provisions of the blade ring 14, at least two actuators 80 can be used but additional actuators 80 can be employed if necessary. Such actuators can be used to clock the blade ring 14 to a desired position. For example, the actuators can impart tangential forces on the blade ring 14 so as to cause the blade ring 14 to rotate. In one embodiment, the two actuators can be substantially simultaneously used, such as by pulling or pushing, so as to rotate the blade ring 14.

The actuators can be any of a number of devices. For example, the actuators can be formed as cables 80. Alternatively, the actuators can be any of a number of devices including, for example, cords, straps, chains or ropes, to name a few. Alternatively, the actuators can be, for example, gears, hydraulic pistons, hoists, cranes, or winches. The actuators can be any device providing structure adapted for connecting to the attachments 54 and capable of engaging the attachments 54, such as by pulling or pushing, so as to rotate the blade ring 14 by, for example, imparting a substantially tangential force.

Having described the individual components and their assembly according to aspects of the present invention, one illustrative manner in which these components can be used to facilitate blade ring clocking will now be described. The following description is merely an example of a sequence in which the individual steps can occur. The described steps can be performed in almost any order and not every step described must occur.

Initially, several components are provided including an outer casing 12, a blade ring 14, a plurality of pins 60, and a plurality of roller pins 70. The outer casing 12 can have an elongated hollow body, an outer peripheral surface 20 and an inner peripheral surface 18. The outer casing 12 can have a first set of openings 30 and a second set of openings 31. Each of the openings 30,31, regardless of whether the opening 30,31 belongs to the first or second set, extends between the outer and inner surfaces 18,20 of the outer casing 12.

The blade ring 14 can be disposed inside of the outer casing 12. The blade ring 14 can have an inner peripheral surface 42 and an outer peripheral surface 40. Further, the blade ring 14 can include a plurality of airfoils 16 attached to the inner peripheral surface 42 and a plurality of notches 50 in the outer peripheral surface 40.

A plurality of pins 60 can be inserted through the first set of openings 30 in the outer casing 12 so as to engage at least some of the notches 50 in the outer peripheral surface 40 of the blade ring 14 such that the blade ring 14 is substantially fixedly held within the outer casing 12. Not only do the pins 60 prevent the blade ring 14 from rotating, but they also can support the weight of the blade ring 14 and can maintain the blade ring 14 radially inwardly away from the outer casing 12. With respect to the roller pins 70, each roller pin 70 has a roller 76 at one end.

Once these components are provided, the plurality of roller pins 70, such at least three pins, can be inserted through the second set of openings 31 in the outer casing 12 such that the roller end 76 of each of the roller pins 70 engages the outer peripheral surface 40 of the blade ring 14. The roller pins 70 can engage the blade ring 14 at substantially equidistant points about the outer periphery 40 of the blade ring 14. Once all the roller pins 70 are installed, the anti-rotation pins 60 can be disengaged from the notches 50 in the outer peripheral surface 40 of the blade ring 14. The step of disengaging can include completely removing the anti-rotation pins 60 out of the outer casing 12 and blade ring assembly 10. Alternatively, the step of disengaging can mean that the pins 60 remain at least partially in the openings 31 in the outer casing, but are retracted enough so that the tips 66 of the pins 60 no longer engage the notches 50 so that the notches 50 no longer impede rotation of the blade ring 14. Once the pins 60 are disengaged, the blade ring 14 is held in position and supported entirely by the plurality of roller pins 70.

The outer casing 12 can include a plurality of removable access panels 28 for permitting access to the blade ring 14. Further, the blade ring 14 can include at least two integral pairs of attachments 54. The attachments 54 can be eyelets, lugs, hooks, loops, ears, posts, and hitches. Integral attachments 54 can include attachments that are detachably connected to the blade ring 14 such as by bolts or other fasteners or by more permanent connections such as by welding or brazing. Preferably, the access panels 28 are situated so as to allow a user access to at least the pair of attachments 54.

The method according to aspects of the invention can further include removing at least one of the access panels 28 on the outer casing 12. Next, a first actuator can be attached to one attachment of a first pair of attachments 54, and a second actuator can be connected to the other attachment of the first pair of attachments 54. The first and second actuators can be cables 80, chains, straps, ropes, and other devices discussed earlier. Further, the first and second actuators can but need not be identical. Once attached, the first and second actuators can be used to rotate the blade ring 14 in a first direction by imparting substantially tangential forces on the blade ring 14. When the first and second actuators are cables 80 or chains, for example, the first and second actuators can be substantially simultaneously pulled so that a tangential force is imparted on the blade ring 14. The rotation of the blade ring 14 is permitted and facilitated by the engagement with the rollers 76 of the roller pins 70. The first direction can be clockwise 90 or counterclockwise. In other words, the blade ring 14 can rotate about its centerline.

If the blade ring 14 is not in the desired position, the actuators can be used again, such as by substantially simultaneously pulling, to rotate the blade ring by imparting, for example, a tangential force on the blade ring 14. The rotation may occur in the first direction, that is, the direction in which the blade ring 14 has already been rotated, or the rotation may occur in a second direction, opposite to the first direction. Such use of the actuators can be repeated until the blade ring 14 is rotated into the desired position.

However, due to structural interferences or other constraints, it may not be possible to use the first pair of attachments 54 to rotate the blade ring 14 in a direction opposite to the first direction. In such case, a third actuator (not shown) can be attached to one attachment of a second pair of attachments (not shown), and a fourth actuator (not shown) can be attached the other attachment of the second pair of attachments (not shown). It should be noted that the first and second actuators can be used as the third and fourth actuators.

The third and fourth actuators can be used to rotate the blade ring 14 in a second direction or, if necessary, the first direction. For example, the third and fourth actuators can be substantially simultaneously pulled so as to impart a tangential force on the blade ring 14 such that the blade ring 14 rotates in a second direction. If further adjustment of the blade ring is needed, then the first and second actuators or third and fourth actuators can be used in any of the manners described above so as to rotatably adjust the blade ring 14 in the first direction or in the second direction. The adjustments can continue until the desired blade ring clocking is achieved.

When the blade ring is in the desired position, the plurality of anti-rotation pins 60 can be reinstalled through the first set of openings 30 in the outer casing such that the tips 66 of the pins 60 engage at least some of the notches 50 in the outer peripheral surface 40 of the blade ring 14 such that the blade ring 14 is substantially fixedly held within the outer casing 12. At that point, the roller pins 70 can be removed.

Aspects of the present invention are especially suited for upstream airfoils, such as the row 1 and row 2 vanes, of a turbine, but aspects of the invention can be applied to any row of airfoils. Further, aspects of the invention can be applied to other portions of a turbine engine such as the compressor section. Aspects of the present invention can be employed with respect to myriad turbine designs as one skilled in the art would appreciate.

It will of course be understood that the invention is not limited to the specific details described herein, which are given by way of example only, and that various modifications and alterations are possible within the scope of the invention as defined in the following claims.

What is claimed is:

1. A method for clocking a blade ring containing a plurality of airfoils relative to another row of airfoils comprising the steps of:

(a) providing an outer casing having an elongated hollow body, an outer peripheral surface and an inner peripheral surface, the outer casing having a first set of openings and a second set of openings, each of the openings extending between the outer peripheral surface and the inner peripheral surface of the outer casing;

(b) providing a blade ring disposed inside of the outer casing, the blade ring having an inner peripheral surface and an outer peripheral surface, the blade ring including a plurality of airfoils attached to the inner peripheral surface and a plurality of notches in the outer peripheral surface;

(c) providing a plurality of pins inserted through the first set of openings in the outer casing and engaging at least some of the notches in the outer peripheral surface of the blade ring such that the blade ring is substantially fixedly held within the outer casing;

(d) providing a plurality of roller pins, each of the roller pins having a roller at one end;

(e) inserting the plurality of roller pins through the second set of openings such that the roller of each of the roller pins engages the outer peripheral surface of the blade ring; and (f) disengaging the pins from the notches in the outer peripheral surface of the blade ring, whereby the blade ring is held in position and supported by the plurality of roller pins.

2. The method of claim 1 wherein the blade ring includes at least one pair of attachments.

3. The method of claim 2 further comprising the steps of:

(g) attaching a first actuator to one attachment of a first pair of attachments; and (h) attaching a second actuator to the other attachment of the first pair of attachments.

4. The method of claim 3 wherein the pair of attachments include one of eyelets, lugs, hooks, loops, ears, posts, and hitches.

5. The method of claim 3 wherein the first and second actuators are one of cables, chains, straps, ropes, gears, hydraulic cylinders, cranes, and winches.

6. The method of claim 3 further comprising the step of:

(i) rotating the blade ring in a first direction by using the first and second actuators to impart substantially tangential forces on the blade ring.

7. The method of claim 6 wherein the first direction is one of clockwise or counterclockwise.

8. The method of claim 6 further including the step of:

(j) rotating the blade ring in one of the first direction or a second direction by using the first and second actuators to impart substantially tangential forces on the blade ring.

9. The method of claim 8 further including the step of:

(k) repeating step (j) until the blade ring is rotated into the desired position.

10. The method of claim 9 further including the steps of:

(l) reinstalling the plurality of pins through the first set of openings in the outer casing such that the pins engage at least some of the notches in the outer peripheral surface of the blade ring such that the blade ring is substantially fixedly held within the outer casing; and (m) removing the plurality of roller pins.

11. The method of claim 6 further comprising the steps of:

(n) attaching a third actuator to an attachment of a second pair of attachments; and (o) attaching a fourth actuator to the other attachment of the second pair of attachments.

12. The method of claim 11 wherein the third and fourth actuators are one of cables, chains, straps, ropes, gears, hydraulic cylinders, cranes, and winches.

13. The method of claim 11 further including the step of:

(p) rotating the blade ring in a second direction by using the third and fourth actuators to impart substantially tangential forces on the blade ring.

14. The method of claim 13 further including the step of:

(q) repeating at least one of steps (j) and (p) until the blade ring is rotated into the desired position.

15. A blade ring for a turbine engine comprising:

a hollow substantially cylindrical body having an inner peripheral surface and an outer peripheral surface;

a plurality of airfoils attached to the inner peripheral surface of the body;

a plurality of notches in the outer peripheral surface of the body, said plurality of notches adapted to cooperatively define a plurality of circumferentially-distinct orientations; and at least one pair of attachments on the outer peripheral surface, whereby said plurality of notches facilitates airfoil clocking.

16. The blade ring of claim 15 wherein the at least one pair of attachments are one of eyelets, lugs, hooks, loops, ears, posts, and hitches.

17. The blade ring of claim 15 wherein one attachment of the at least one pair of attachments is disposed substantially peripherally opposite to the other attachment of the at least one pair of attachments.

18. The blade ring of claim 15 wherein the plurality of notches are disposed substantially equidistantly about the outer periphery of the blade ring.

19. The blade ring of claim 15 wherein the plurality of notches includes at least four groups of notches, wherein each group includes three notches, the groups of notches being disposed substantially equidistantly about the outer periphery of the blade ring.

20. A method for clocking a blade ring containing a plurality of airfoils relative to another row of airfoils comprising the steps of:

(a) providing an outer casing having an elongated hollow body, an outer peripheral surface and an inner peripheral surface, the outer casing having a first set of openings and a second set of openings, each of the openings extending between the outer peripheral surface and the inner peripheral surface of the outer casing;

(b) providing a blade ring disposed inside of the outer casing, the blade ring having an inner peripheral surface and an outer peripheral surface, the blade ring including a plurality of airfoils attached to the inner peripheral surface and a plurality of notches in the outer peripheral surface, wherein the blade ring includes at least one integral pair of attachments and the outer casing includes at least one removable access panel for permitting access to the at least one pair of attachments;

(c) providing a plurality of pins, the pins being inserted through the first set of openings in the outer casing and engaging at least some of the notches in the outer peripheral surface of the blade ring such that the blade ring is substantially fixedly held within the outer casing;

(d) providing at least three roller pins, each of the roller pins having a roller at one end;

(e) inserting the at least three roller pins through the second set of openings such that the roller of each of the roller pins engages the outer peripheral surface of the blade ring;

(f) disengaging the pins from the notches in the outer peripheral surface of the blade ring, wherein the blade ring is substantially held in position and substantially supported by the at least three roller pins;

(g) removing the at least one access panel;

(h) attaching a first actuator to an attachment of a first pair of attachments, wherein the first actuator is one of cables or chains;

(i) attaching a second actuator to the other attachment of the first pair of attachments, wherein the second actuator is one of cables or chains;

(j) rotating the blade ring by substantially simultaneously pulling the first and second actuators so as to impart substantially tangential forces on the blade ring, whereby rotation of the blade ring is facilitated by engagement with the roller pins.

* * * * *